US011421966B1

(12) United States Patent
Staats

(10) Patent No.: US 11,421,966 B1
(45) Date of Patent: Aug. 23, 2022

(54) TARGET WITH TARGET DISK STORAGE

(71) Applicant: Ryan Staats, Blairsville, PA (US)

(72) Inventor: Ryan Staats, Blairsville, PA (US)

( * ) Notice: Subject to any disclaimer, the term of this patent is extended or adjusted under 35 U.S.C. 154(b) by 0 days.

(21) Appl. No.: 17/068,815

(22) Filed: Oct. 12, 2020

Related U.S. Application Data

(60) Provisional application No. 62/924,642, filed on Oct. 22, 2019.

(51) Int. Cl.
*F41J 1/10* (2006.01)
*F41J 5/26* (2006.01)

(52) U.S. Cl.
CPC ... *F41J 1/10* (2013.01); *F41J 5/26* (2013.01)

(58) Field of Classification Search
CPC ..... F41J 1/10; F41J 5/26; F41J 9/16
See application file for complete search history.

(56) References Cited

U.S. PATENT DOCUMENTS 1,378,340 A * 5/1921 Fairchild ..... F41J 5/26 273/380
1,723,826 A 8/1929 Van Auken
2,026,831 A 1/1936 Graf
2,048,155 A * 7/1936 Armantrout ..... F41J 7/00 273/407
2,130,289 A * 9/1938 Phelps ..... F41J 7/04 273/385
2,297,993 A 10/1942 Tratsch
3,080,166 A 3/1963 Clark
3,087,701 A * 4/1963 Wallace ..... F41J 1/10 248/166
3,423,092 A * 1/1969 Kandel ..... F41J 1/01 273/378
4,323,251 A 4/1982 Loveland
4,498,677 A * 2/1985 Dapkus ..... F41J 5/24 102/335
D329,665 S 9/1992 Carroll
5,145,133 A 9/1992 France
5,280,920 A 1/1994 Knapper, II
5,829,753 A 11/1998 Wiser
5,938,203 A * 8/1999 Beckwith, Sr. ..... F41J 1/10 273/407
5,947,477 A * 9/1999 Turnipseed ..... F41J 1/10 273/407
6,913,263 B2 7/2005 Fort, II
7,293,774 B1 11/2007 Shawd
7,422,217 B2 9/2008 Hinnant
(Continued)

*Primary Examiner* — Laura Davison
(74) *Attorney, Agent, or Firm* — Quickpatents, LLC; Kevin Prince

(57) ABSTRACT

A target stand for supporting target disks above a ground surface includes a rigid support stand that comprises two side members each having a top end, a bottom end, and a central area, and in some embodiments a cross bar spanning between the central areas of the side members. A target supply mechanism comprises at least a front plate and a rear plate, a target disk track being defined therebetween from a top edge to a bottom edge between the plates. Each side edge of the target supply mechanism is fixed to the top end of one of the side members. A target holder is fixed proximate the bottom edge of the target supply mechanism to receive one or more of the target disks from the target supply mechanism and present the target disks to a target shooter.

11 Claims, 9 Drawing Sheets

(56) References Cited

U.S. PATENT DOCUMENTS

| | | | | |
|---|---|---|---|---|
| 7,644,927 | B2 * | 1/2010 | Law | F41J 1/10 273/407 |
| 8,919,778 | B2 | 12/2014 | Fodera | |
| 9,163,913 | B2 | 10/2015 | Laporte | |
| 9,784,539 | B1 | 10/2017 | Preuss | |
| 10,113,841 | B2 | 10/2018 | Foley | |
| 2008/0211190 | A1 | 9/2008 | Smith | |
| 2013/0252719 | A1 * | 9/2013 | Rowe | G07F 17/3237 463/25 |
| 2013/0328269 | A1 * | 12/2013 | Tsipouras | F41J 13/00 273/410 |
| 2016/0298942 | A1 | 10/2016 | Skinner | |
| 2019/0212108 | A1 | 7/2019 | Laporte | |

* cited by examiner

TARGET WITH TARGET DISK STORAGE

CROSS-REFERENCE TO RELATED APPLICATIONS

This application claims the benefit of U.S. Provisional Patent Application 62/924,642, filed on Oct. 22, 2019, and is incorporated herein by reference.

STATEMENT REGARDING FEDERALLY SPONSORED RESEARCH AND DEVELOPMENT

Not Applicable.

FIELD OF THE INVENTION

This invention relates to target shooting, and more particularly to a target that dispenses target disks.

BACKGROUND

Target shooting is a popular pastime, and targets that break or crumble are particularly enjoyable for sportsmen. As such, standard clay pigeons or "clays" are popular not just for shooting with a shotgun but also for setting up downrange on a hill or other support for use as target. One drawback to setting-up targets in this manner is that the target clays, once shot, do not replenish themselves. This requires the sportsman to frequently trek downrange to replace the target clays and then repeat the process.

Therefore, there is a need for an apparatus that would store a plurality of the clay targets and, as each target is hit, replace the target with one in a clay target supply. Such a needed invention would not require electricity, would be simple to set-up and use, and would collapse for compact storage and transport. The needed invention would allow for multiple different target overlays for variety, and could use clay targets of various sizes for changing the level of skill required to hit the targets. The present invention accomplishes these objectives.

SUMMARY OF THE INVENTION

The present device is a target stand for supporting a plurality of target disks above a ground surface for a target shooter. Such a target shooter might be shooting the target disks with a rifle, arrow, baseball, or the like. The target disks are preferably standard clay pigeons, but may also be larger or smaller disks made from clay, plastic, paper, or other suitable materials that will substantially crack and break when struck by a projectile such as a bullet, arrow, sports ball, or the like.

The target stand includes a rigid support stand that comprises two side members each having a top end, a bottom end, and a central area. Each side member may further include a rigid foot fixed with the bottom end thereof, the foot adapted for contacting the ground surface. A rigid cross bar has two opposing ends each of which are adapted for fixing with the central area of one of the side members.

A target supply mechanism comprises at least a front plate and a rear plate. The target supply mechanism has a top edge, a bottom edge, and two opposing side edges. The front plate and rear plate define a target disk track therebetween from the top edge to the bottom edge between the front plate and the rear plate. Each side edge of the target supply mechanism is fixed to the top end of one of the side members, preferably rotationally, so that the target supply mechanism is rotationally attached to the support stand. A target holder is fixed proximate the bottom edge of the target supply mechanism proximate the target disk track, such that the target holder can receive one or more of the target disks from the target supply mechanism and present the target disk to the target shooter.

As such, in use, with the target stand supported on the ground surface and the target disk track of the target supply mechanism filled from the top edge with the target disks, the target disks traverse the target disk track by gravity from the top edge of the target supply mechanism to the bottom edge of the target supply mechanism to the target holder. One of the target disks in the target holder is then presented to the target shooter who, by shooting the target disk removes the target disk from the target holder to allow a next target disk in the target disk track to drop down into the target holder.

In some embodiments the target holder further includes a target overlay holder adapted to hold a target overlay at a front side of the target holder. Such a target overlay may be a printed piece of paper, cardboard, or the like that includes a printed "Bull's-Eye" or other printed target image, for example.

The present invention is an apparatus that stores a plurality of the target disks and, as each target disk is hit, replaces the target disk with another target disk from the target disk supply. The present invention does not require electricity, and is simple to set-up and use. Further, the present invention collapses for compact storage and transport. The present apparatus further allows for multiple different target overlays for variety, and can use target disks of various sizes for changing the level of skill required to hit the target disks. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
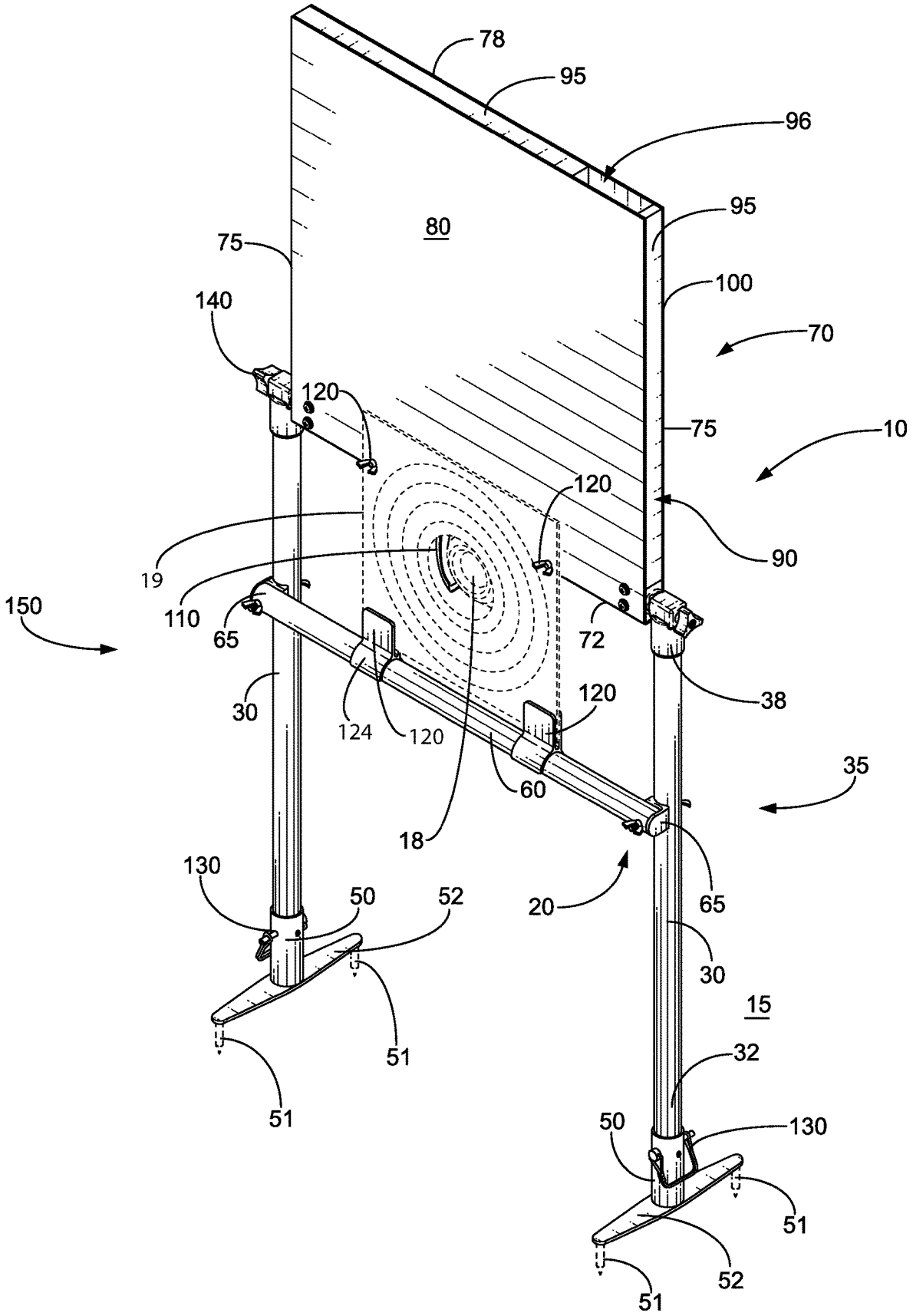
FIG. 1 is a front perspective view of the invention, illustrating a target supply mechanism in an extended position on a support stand.
Figure 2:
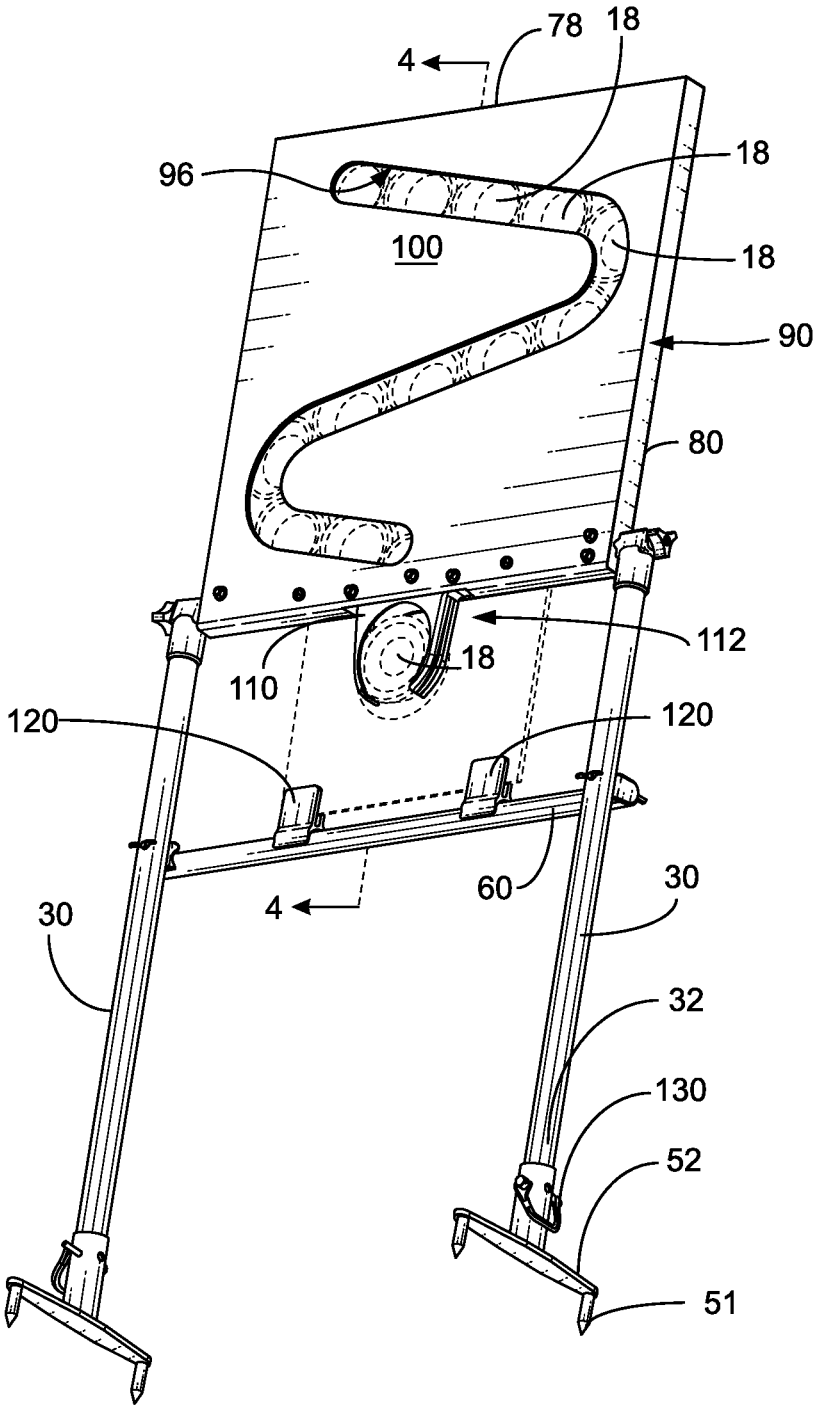
FIG. 2 is a rear perspective view of the invention as illustrated in FIG. 1, showing target disks and a target overlay in broken lines.

FIGS. 1 and 2 illustrate a target stand 10 for supporting a plurality of target disks 18 above a ground surface 15 for a target shooter (not shown). Such a target shooter might be shooting the target disks 18 with a rifle (not shown), arrow (not shown), baseball (not shown) or the like. The target disks 18 are preferably standard clay pigeons, but may also be larger or smaller disks 18 made from clay, plastic, paper, or other suitable materials that will substantially crack and break when struck by a projectile such as a bullet, arrow, sports ball, or the like.

The target stand 10 includes a rigid support stand 20 that comprises two side members 30 each having a top end 38, a bottom end 32, and a central area 35. Each side member may further include a rigid foot 50, preferably made of metal or strong plastic, fixed with the bottom end 32 thereof, the foot 50 adapted for contacting the ground surface 15. Preferably the bottom end 32 of each side member 30 includes a foot attachment mechanism 130, such that the foot 50 can be selectively attached with the side member 30. In some embodiments the foot 50 includes at least one ground-penetrating spike 51 for securing the target stand 20 to the ground surface 15. In other embodiments the foot 50 include a wide base member 52 for supporting the target stand 10 upright on the ground surface 15 and having a large enough footprint to inhibit tipping over of the target stand if inadvertently struck by a stray projectile, such as a bullet or arrow. The side members 30 may be made of round or square metal stock, PVC pipe, or the like. Preferably, however, the side members 30 are made from a metallic material to resist damage when struck by a high-speed projectile such as a bullet.

Figure 6:
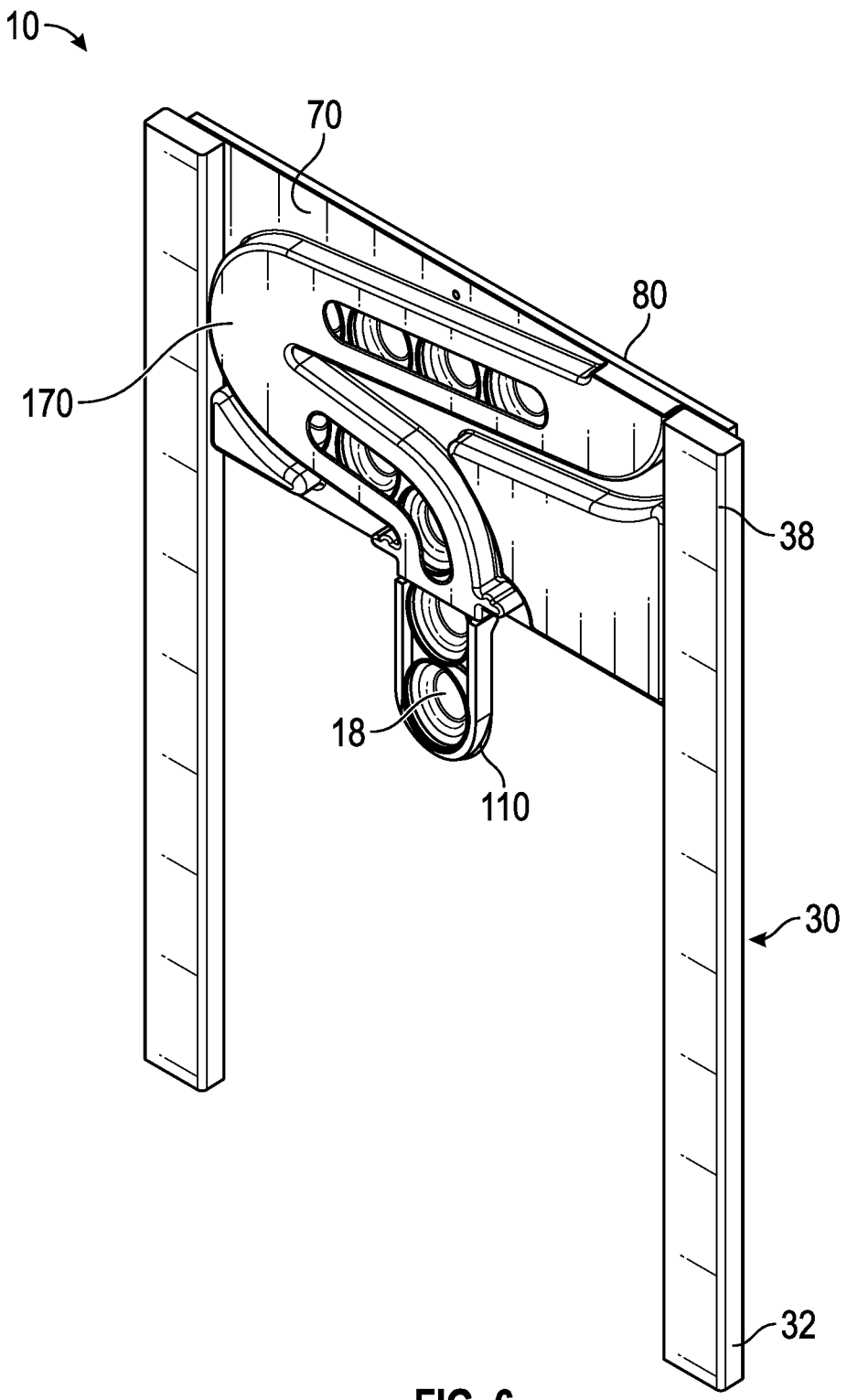
FIG. 6 is a rear perspective view of an alternate embodiment of the invention.
Figure 7:
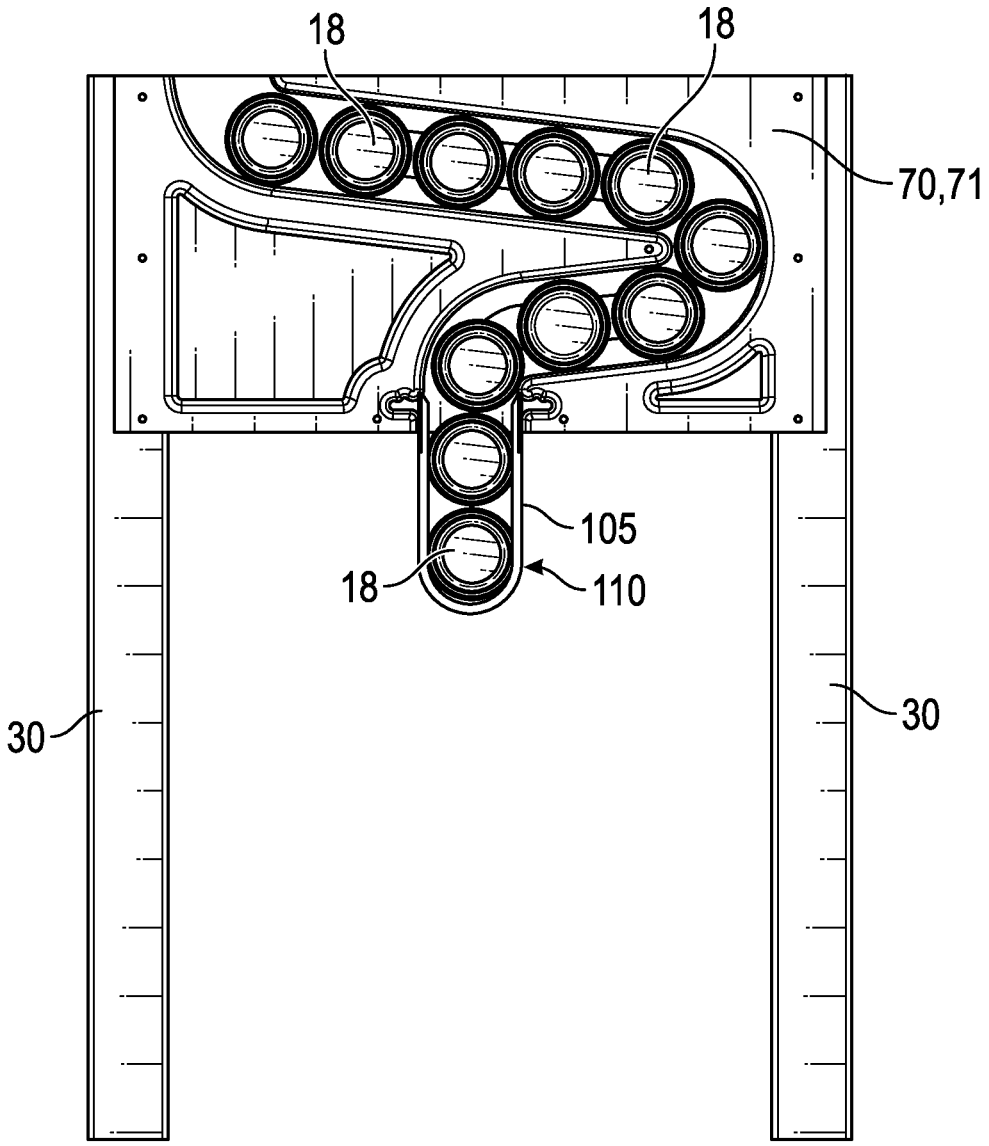
FIG. 7 is a front elevational view of the embodiment of FIG. 6.
Figure 8:
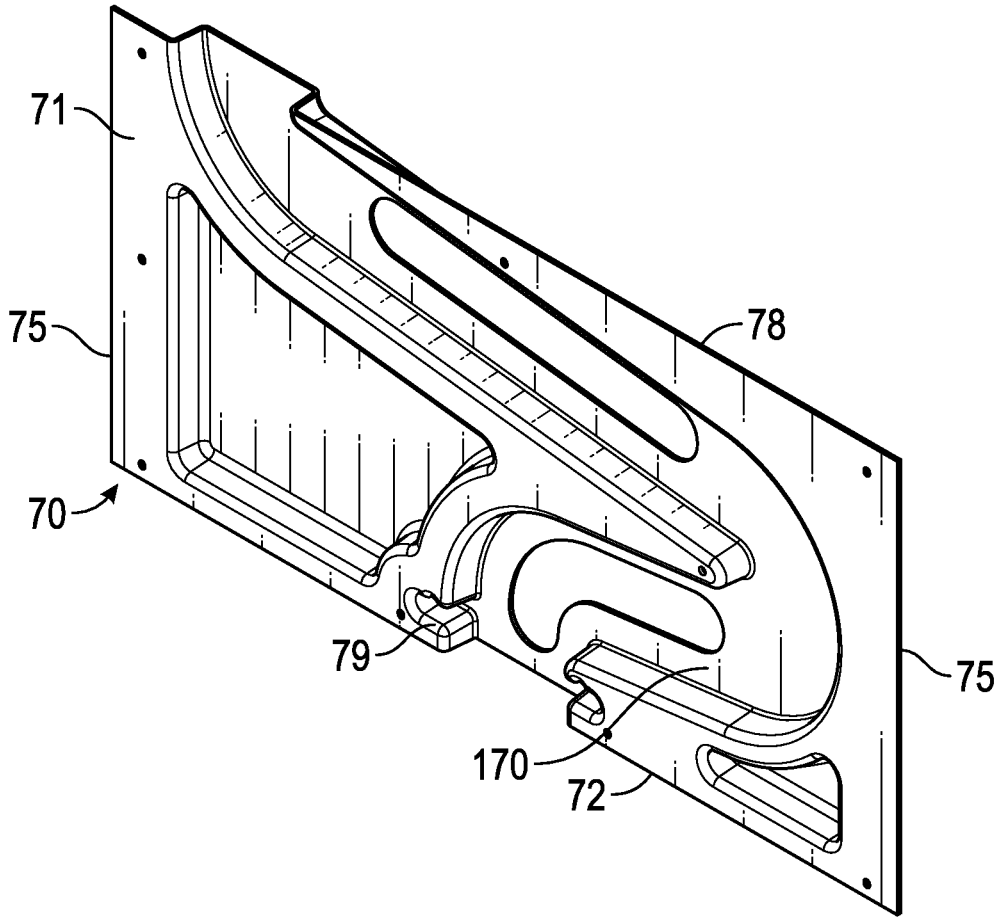
FIG. 8 is a front perspective view of a rear plate of the embodiment of FIG. 6.

In some embodiments, illustrated in FIGS. 6 and 7, the bottom end 32 of each side member 30 is driven into the ground surface 15, such as with a hammer or the like. The bottom end 32 of each side member 30 may be pointed to facilitate ground penetration in such embodiments.

A rigid cross bar 60 may be included that has two opposing ends 65 each of which are adapted for fixing with the central area 35 of one of the side members 30, such as with mechanical fasteners 38 (FIG. 1) common in the art, such as screws and nuts or wingnuts, rivets, or the like.

Figure 3:
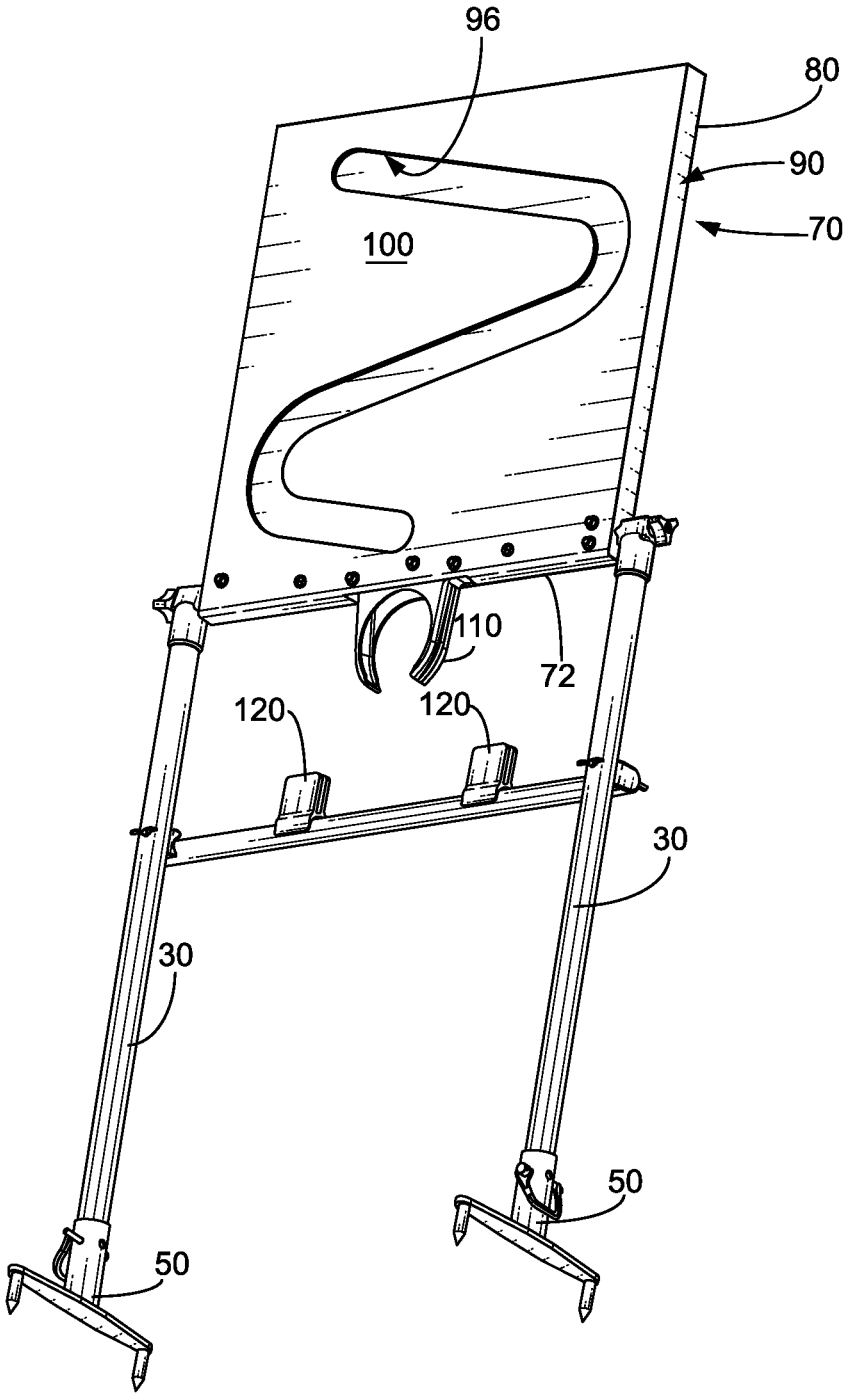
FIG. 3 is a rear perspective view of the invention as illustrated in FIG. 2, but with the target disks and target overlay omitted for clarity of illustration.
Figure 4:
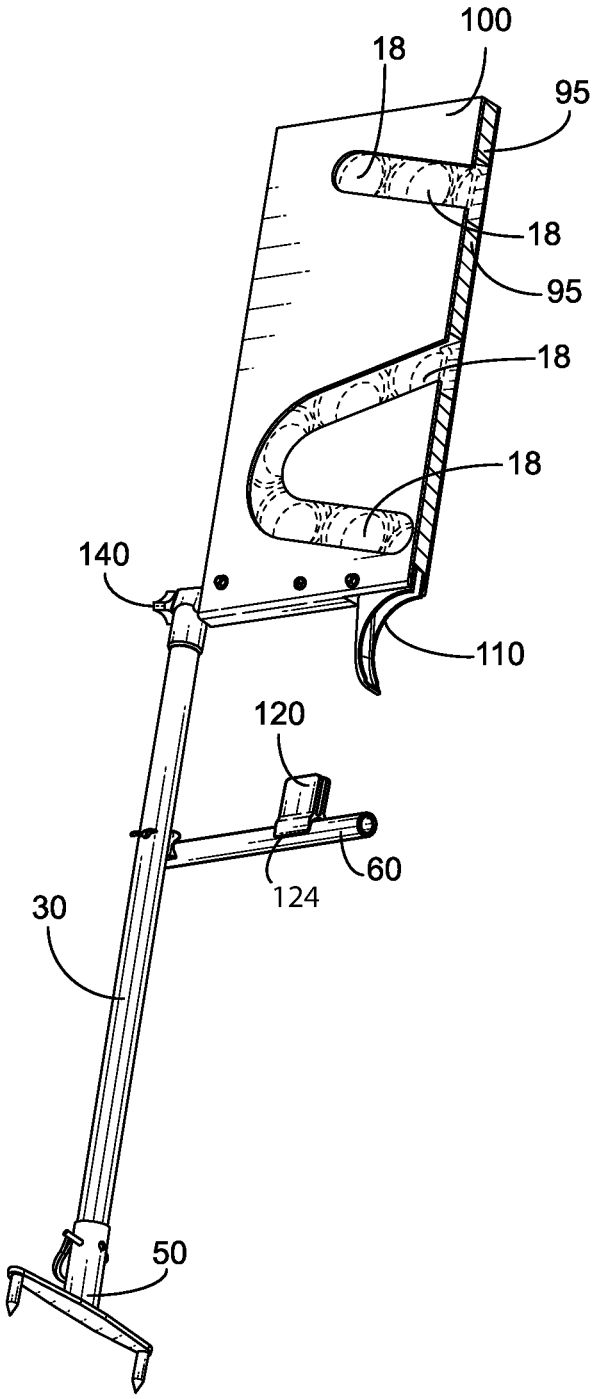
FIG. 4 is a perspective cross-sectional view of the invention, taken along line 4-4 of FIG. 2.

A target supply mechanism 70, in some embodiments, comprises a spacer layer 90 sandwiched between a front plate 80 and a rear plate 100. The target supply mechanism 70 has a top edge 78, a bottom edge 72, and two opposing side edges 75. The spacer layer 90 includes two spacers 95 separated to define a target disk track 96 (FIGS. 3 and 4) that traverses the spacer layer 90 from the top edge 78 of the target supply mechanism 70 to the bottom edge 72 of the target supply mechanism 70 between the front plate 80 and the rear plate 90. Preferably the target disk track and the target supply mechanism 70 are sized to accommodate about 20 of the target disks 18. Each side edge 75 of the target supply mechanism 70 is fixed to the top end 38 of one of the side members 30, preferably rotationally so, so that the target supply mechanism 70 is rotationally attached to the support stand 20.

A target holder 110 is fixed proximate the bottom edge 72 of the target supply mechanism 70 proximate the target disk track 96, such that the target holder 110 can receive one of the target disks 18 from the target supply mechanism 70 and present the target disk 18 to the target shooter (FIG. 1). The target holder 110 is preferably made from a rigid plastic or strong paper-based material.

As such, in use, with the target stand 10 supported on the ground surface 15 and the target disk track 96 of the target supply mechanism 70 filled from the top edge 78 with the target disks 18, the target disks 18 traverse the target disk track 96 by gravity from the top edge 78 of the target supply mechanism 70 to the bottom edge 72 of the target supply mechanism 70 to the target holder 110. One of the target disks 18 in the target holder 110 is then presented to the target shooter who, by shooting the target disk 18 removes the target disk 18 from the target holder 110 to allow a next target disk 18 in the target disk track 96 to drop down into the target holder 110.

In some embodiments the target holder 110 further includes a target overlay holder 120 adapted to hold a target overlay 19 at a front side 112 of the target holder 110. Such a target overlay 19 may be a printed piece of paper, cardboard, or the like that includes a printed "Bull's-Eye" or other printed target image, for example. In some embodiments the cross bar 60 includes at least a portion of the target overlay holder 120, such as holders (not shown) for holding the target overlay upright and supported by the cross bar 60 (FIG. 1). The target overlay holder 120 may include mechanical fasteners 124 as well.

Figure 5:
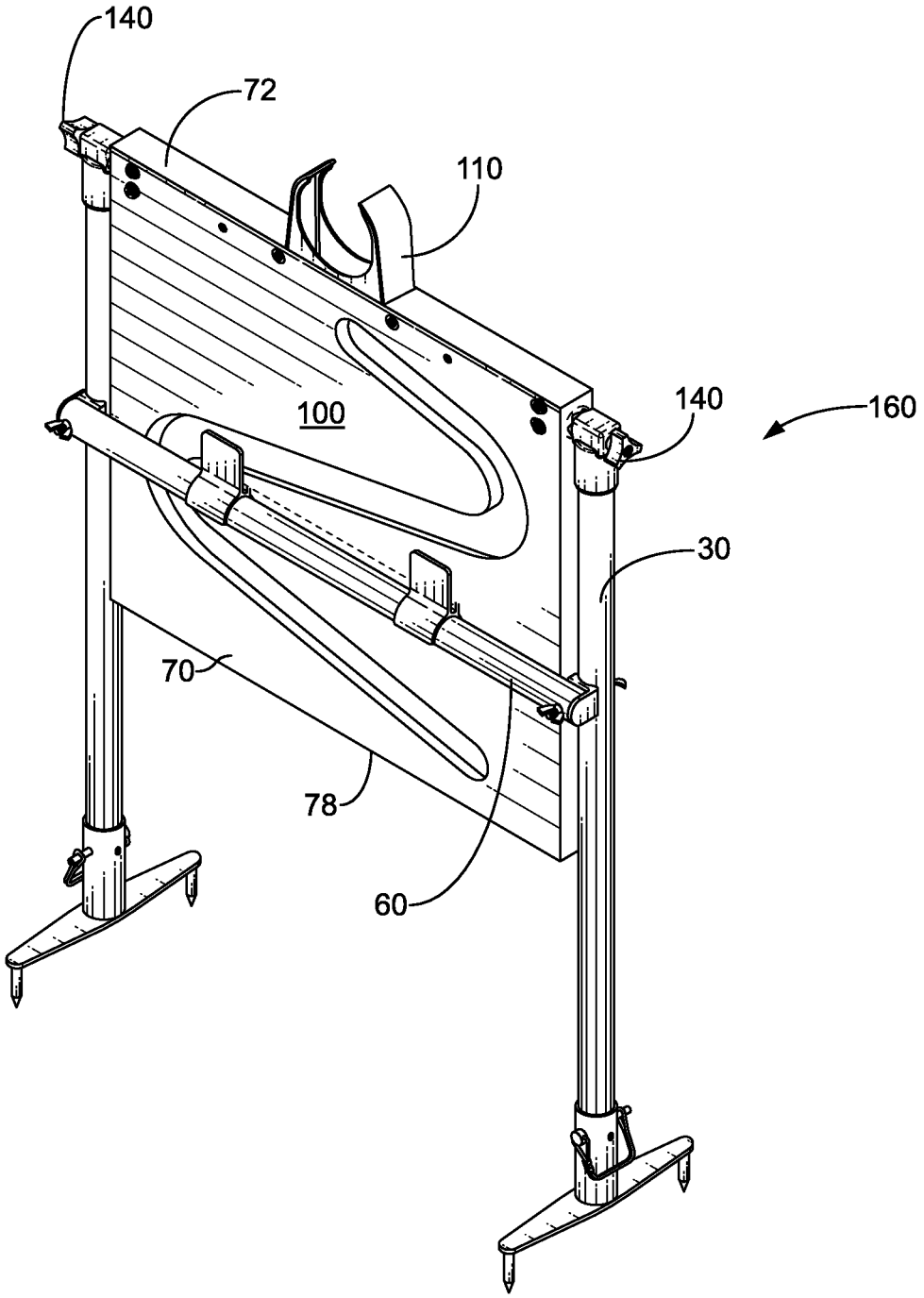
FIG. 5 is a front perspective view of the invention, illustrating the target supply mechanism in a collapsed position for facilitating transport and storage of the invention.

In some embodiments the target supply mechanism 70 is rotationally fixed with the side members 30 of the support stand 20 and further includes a manually-actuable tension knob 140 for adjusting the frictional engagement between the target supply mechanism 70 and each side member 30 of the support stand 20. The target supply mechanism 70 and the top end 38 of each side member 30 may include cooperative radial grooves (not shown) to greatly increase the friction between the target supply mechanism 70 and the side members 30. Other types of hinges or rotational supports may be used as is known in the art. As such, the target supply mechanism 70 can be rotated to be aligned with the side members 30 and mostly above the side members 30 in an extended position 150, or pivoted down so that the target supply mechanism 70 is inverted from the extended position 150 and substantially between the two side members 30 in a collapsed position 160 (FIG. 5).

Preferably the front plate 80 and the rear plate 100 of the target supply mechanism 70 made from a cardboard or cardstock web of paper, and each spacer 95 is made from an open cell or closed cell foam, such that bullets or projectiles can penetrate the front plate 80, spacers 90, and rear plate 100 and pass completely through. Preferably the target supply mechanism 70 is easily interchanged with an old or damaged target supply mechanism 70 by unscrewing the tension knobs 140 to release the target supply mechanism 70 from the support stand 20.

In an alternate preferred embodiment, the target supply mechanism 70 comprises the rear plate 100 that has a recessed target disk track 170 (FIGS. 6-9) formed into a front side 71 thereof. The front plate 80 covers the front side 71 of the rear plate 100, capturing the target disks 18 between the front plate 80 and the rear plate 100 within the recessed target disk track 170.

Figure 9:
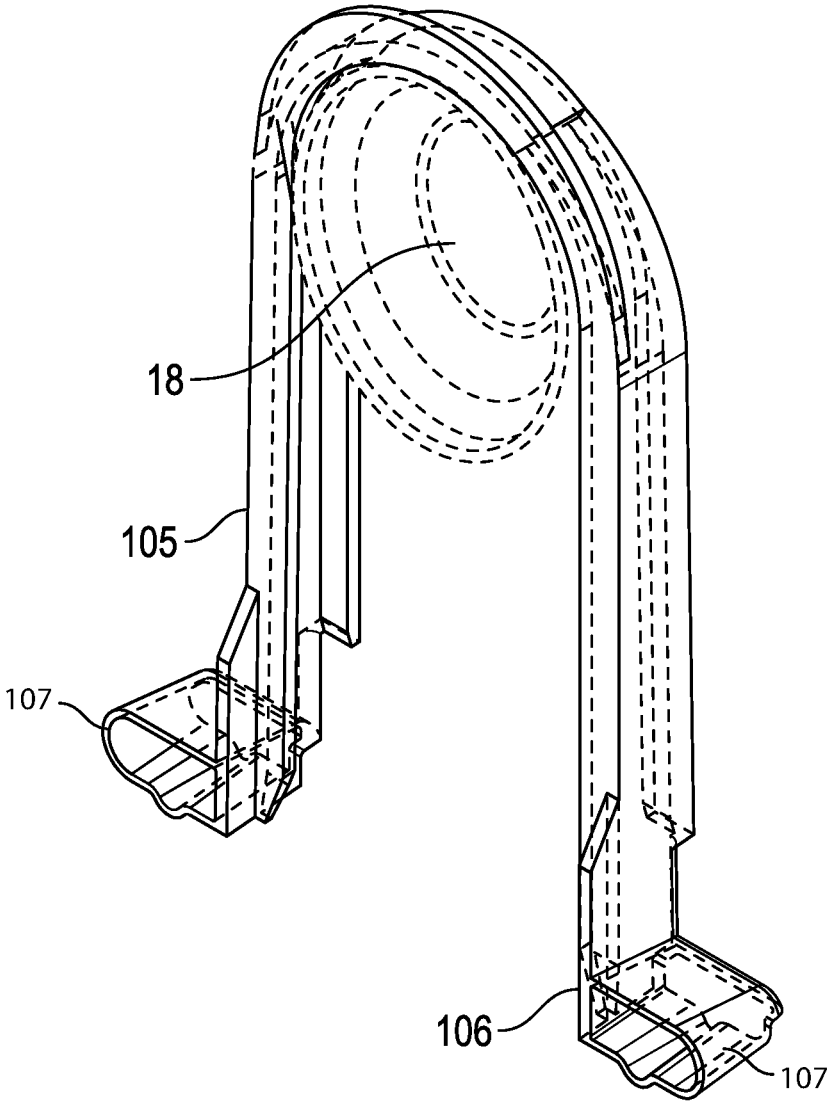
FIG. 9 is a perspective view of the target holder of FIGS. 6-8.

In some preferred embodiments, the target holder 110 is generally U-shaped and includes an attachment prong 107 at a top end 106 of each of two legs 105 thereof (FIG. 9). Each attachment prong 107 is configured for engaging an attachment recess 79 of the target supply mechanism 70 adjacent the bottom edge 72 thereof. As such, if the target holder 110 becomes damaged such as by gunfire or shrapnel, the target holder 110 can be quickly replaced by removing each target disk 18, pulling the attachment prongs 107 of the target holder 110 away from the target supply mechanism 70, and then installing a new target holder 110 by pressing the attachment prongs 107 of the target holder 110 into the attachment recesses 79 of the target supply mechanism 70. The target disks 18 may then be reloaded into the recessed target disk track 170 by dropping them into the recessed target disk track 170 at the top edge 78 of the target supply mechanism 70.

While a particular form of the invention has been illustrated and described, it will be apparent that various modifications can be made without departing from the spirit and scope of the invention. For example, while the target supply mechanism 70 is shown as rectangular in the drawings, the target supply mechanism 70 could also be oval, circular, or other suitable shape. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A target stand for supporting a plurality of target disks above a ground surface for a target shooter, comprising:

a support stand comprising two side members each having a top end, a bottom end, and a central area;

a target supply mechanism comprising a rear plate having a recessed target disk track in a front surface thereof, and a front plate covering the front side of the rear plate, the target supply mechanism having a top edge, a bottom edge, and two side edges, the side edges each fixed with one of the side members of the support stand;

a target holder fixed proximate the bottom edge of the target supply mechanism proximate the target disk track, the target holder adapted to receive one or more of the target disks from the target supply mechanism and present the target disk to the target shooter;

wherein the target holder is removably attached to the target supply mechanism, and wherein the target holder is generally U-shaped and includes an attachment prong at a top end of two legs thereof, each attachment prong configured for engagement with an attachment recess of the target supply mechanism proximate the bottom edge thereof;

whereby with the target stand supported on the ground surface and the target disk track of the target supply mechanism filled from the top edge with the target disks, the target disks traverse the target disk track by gravity from the top edge of the target supply mechanism to the bottom edge of the target supply mechanism to the target holder, one of the target disks in the target holder presented to the target shooter who, by shooting the target disk, removes the target disk from the target holder to allow a next disk in the target disk track to drop down into the target holder.

2. The target stand of claim 1 wherein the target holder further includes a target overlay holder adapted to hold a target overlay at a front side of the target holder.

3. The target stand of claim 2 further comprising a cross bar having two opposing ends, each end thereof adapted for fixing with the central area of one of the side members, wherein the cross bar further includes at least a portion of the target overlay holder.

4. The target stand of claim 1 wherein the bottom end of each side member includes a foot and a foot attachment mechanism, whereby the foot is selectively attached with the side member.

5. The target stand of claim 4 wherein the foot includes at least one ground-penetrating spike for securing the target stand into the ground surface.

6. The target stand of claim 4 wherein each foot includes a wide base member for supporting the target stand upright on the ground surface.

7. The target stand of claim 1 wherein the target supply mechanism is rotationally fixed with the side members of the support stand and further including a manually-actuable tension knob for adjusting a frictional engagement between the target supply mechanism and each side member of the support stand.

8. The target stand of claim 7 wherein the target supply mechanism may be rotationally fixed substantially above and aligned with the side members of the support stand in an extended position, and may be rotationally fixed substantially below the top end of each side member and inverted in a collapsed position substantially 180-degrees opposite the extended position.

9. The target stand of claim 1 wherein the front plate of the target supply mechanism is a cardboard web.

10. The target stand of claim 1 wherein the rear plate of the target supply mechanism is a cardboard web.

11. The target stand of claim 1 wherein each attachment prong is engaged with one of the attachment recesses with a friction-fit.

* * * * *